US005302206A

United States Patent [19]

Shibata et al.

[11] Patent Number: 5,302,206

[45] Date of Patent: Apr. 12, 1994

[54] EXTRUSION-TYPE APPLICATION DEVICE

[75] Inventors: Norio Shibata; Shinsuke Takahashi; Tsunehiko Sato, all of Kanagawa, Japan

[73] Assignee: Fuji Photo Film Co., Ltd., Kanagawa, Japan

[21] Appl. No.: 498,137

[22] Filed: Mar. 23, 1990

[30] Foreign Application Priority Data

Apr. 5, 1989 [JP] Japan ..... 1-84711

[51] Int. Cl.[5] ..... B05C 3/02; B05C 3/12

[52] U.S. Cl. ..... 118/410; 118/411; 118/419

[58] Field of Search ..... 118/410, 411, 419, 407

[56] References Cited

U.S. PATENT DOCUMENTS

| | | | |
|---|---|---|---|
| 4,681,062 | 7/1987 | Shibata et al. | 118/410 |
| 4,854,262 | 8/1989 | Chino et al. | 118/411 |
| 4,995,339 | 2/1991 | Tobisawa et al. | 118/419 |

*Primary Examiner*—W. Gary Jones
*Assistant Examiner*—Steven P. Griffin
*Attorney, Agent, or Firm*—Sughrue, Mion, Zinn, Macpeak & Seas

[57] ABSTRACT

An extrusion-type application device with which a liquid can be very rapidly applied to a carrier to form a thin layer thereon without causing streaking in the applied layer. The liquid is continuously expelled from the outside part of a slot to the surface of a flexible carrier continuously moving at a speed of 300 m/min or more along the surface of a back edge portion and the surface of a doctor edge portion so that the liquid is applied to the surface of the carrier. The surface of the doctor edge portion is curved, the inner longitudinal edge B of the surface of the back edge portion is located at the outlet of the slot so that the angle $\theta_1$ between a tangent to the surface of the back edge portion at the inner longitudinal edge B and a tangent to the surface of the doctor edge portion at the outer longitudinal edge A of the surface of the doctor edge portion and the angle $\theta_2$ between the former tangent and a tangent to the surface of the doctor edge portion and to the inner longitudinal edge B are as follows:

$$\theta_1 < \theta_2 < 180°,$$

and the radius of curvature R of the surface of the doctor edge portion is less than 2.0 mm.

1 Claim, 5 Drawing Sheets

EXTRUSION-TYPE APPLICATION DEVICE

BACKGROUND OF THE INVENTION

The present invention relates to an extrusion-type application device. More particularly, the invention relates to an improved application device which has a doctor edge portion at the top of the body of the device and which continuously expels a liquid toward the surface of a moving carrier to apply the liquid at a uniform thickness to the surface of the carrier along the doctor edge portion.

The carriers mentioned herein, and which are sometimes referred to as a flexible sheet or a web, may be materials such as a plastic film, paper, polyolefin-coated paper and a metal sheet of aluminum, copper or the like. The carrier may have an undercoating layer or the like.

The coating liquids mentioned herein may be any of a magnetic liquid, a photographic photosensitive liquid or the like and which is applied to the carrier to produce a magnetic recording medium, a photographic film, photographic printing paper or the like.

Various conventional devices have been used for application to a carrier of the above-described types of liquids. Examples of application devices of the extrusion type and having a doctor edge portion are disclosed in Japanese Unexamined Published Patent Applications Nos. 138036/75 and 84771/80 and in Japanese Patent Application No. 7306/79. Such devices have been used in various fields. However, it is a common disadvantage in the conventional devices that the range in which liquid application can be stably performed is very narrow. Especially, it is very difficult with the conventional devices to stably form a liquid layer of 26 μm or less in thickness on a carrier running at a speed of 100 to 150 m/min or more. As a result of studies carried out by the present applicants, it has been found that this disadvantage occurs due to causes which will now be described.

When the speed of movement of the carrier exceeds about 100 to 150 m/min, the quantity of air taken up between the carrier and the extrusion body of the device increases sharply. It is important to accurately control the pressure of the liquid at the outlet part of the slot of the extrusion body if the liquid is to be uniformly applied to the carrier to form a thin layer thereon when the carrier is moving at a speed of 100 to 150 m/min or more. If the pressure of the liquid is not sufficiently high, air bubbles will be taken up into the layer of the applied liquid on the carrier and/or the applied liquid will flow back upstream to partially separate from the carrier and thus make the thickness of the layer nonuniform. If the pressure of the liquid is too high, the thickness of the layer of the applied liquid, which is then applied in a large quantity, is likely to be made nonuniform along the width of the carrier. It has also been found that these undesirable phenomena much depend on the form of the edge portion of the extrusion body of each of the conventional devices.

In order to prevent such phenomena, an improved application device of the extrusion type has been proposed, as disclosed in the Japanese Unexamined Published Patent Application No. 104666/83. In this device, as shown in FIG. 9 herein, a liquid is continuously expelled from the outlet part of a slot 4 to the surface of a flexible carrier W continuously moving along the surface 6*a* of a back edge portion 6 and the surface 20 of a doctor edge portion 5 so that the liquid is applied to the surface of the carrier. The cross section of the doctor edge portion 5 is triangularly shaped. As a result, pressure is exerted on the liquid in such a manner that a relatively large liquid part P is formed on the surface 20 of the doctor edge portion 5 at the slot 4 when the liquid is applied to the carrier. Since the relatively large liquid part P is always pressurized during the application of the liquid to carrier, air is likely to be prevented from being taken up and trapped between the carrier and the extrusion body of the device along the surface 6*a* of the back edge portion 6. For this reason, the liquid can be rapidly applied to the carrier to make a thin uniform layer thereon.

However, streaking occurs in the layer of the applied liquid on the carrier if application is continuously performed by the device over long periods of time. In the case that the product made from the carrier and the liquid applied thereto is a magnetic recording medium, for example, such streaking adversely affects the physical properties of the medium, namely, the S/N ratio, the C/N ratio, and the like. It has been found that when application is continuously performed for a long time, contaminants or foreign matter clinging to the surface of the carrier accumulate in the relatively large liquid part P and cause streaking in the layer of the applied liquid. The contaminants or foreign matter are likely to cling to the surface of the carrier, and cannot be completely removed by rinsing or the like. During application, the contaminants or foreign matter enter the liquid on the extrusion body of the application device. Since the cross section of the doctor edge portion 5 is triangularly shaped so that the portion has a vertex 40, the contaminants or foreign matter are less likely to flow out over the vertex during the application but are accumulated in the relatively large liquid part P to cause streaking in the layer of the applied liquid on the carrier. Particularly when the application is rapidly performed, such streaking is caused even by the momentary catching of a foreign substance in between the carrier and the extrusion body of the application device.

The present inventors have carried out studies in order to provide an application device which has the advantage of the improved application device but which is capable of application without streaking. As a result, they have developed and proposed an application device as disclosed in Japanese Unexamined Published Patent Application No. 238179/85. As shown in FIG. 10, the surface of the doctor edge portion 5 of the device is curved, and a relatively large liquid part P is formed in a pressurized state throughout the application to thus avoid causing streaking and to enable rapid application of the liquid to the surface of a carrier moving at a speed of 300 m/min or less. However, it is technically difficult to make the speed of the rapid application higher than 300 m/min with the conventional device. In other words, air accompanying the carrier is likely to be taken up into the layer of the applied liquid on the carrier in thin-layer rapid application when the speed of the movement of the carrier is 300 m/min or more and the thickness of the applied layer is as ti, small as 10 cc/m$^2$ or less, although the surface of the doctor edge portion 5 of the body of the device is curved in a prescribed manner to prevent streaking from occurring in the layer, as happens with the application device disclosed in Japanese Unexamined Published Patent Application No. 104666/83. More specifically, in the device disclosed therein it is required that the doctor edge portion 5 be curved such that the radius of curvature of the surface is 2 mm or more. If the surface of the doctor edge portion 5 is curved in such a manner that the radius of curvature is less than 2 mm, the behavior of the carrier is so nonuniform along the width thereof as to make the variations in the thickness of the layer of the applied liquid large. Although the minimum applied quantity of the liquid can be reduced by increasing the tension of the carrier so as to increase the pressure of the liquid, if the radius of curvature is set at such a value as not to cause variations in the thickness of the layer, the tension on the carrier becomes such that the carrier is unavoidably stretched, resulting in a reduced product quality, or possibly even a broken carrier.

SUMMARY OF THE INVENTION

The present invention was made in order to solve the above-mentioned problems of the conventional application devices.

Accordingly, it is an object of the present invention to provide an application device with which a liquid can be very rapidly applied to a carrier to form a thin layer thereon without causing streaking in the applied layer.

The application device provided in accordance with the present invention is of the extrusion type in which liquid is continuously expelled from the outside part of a slot to the surface of a flexible carrier continuously moving at a speed of 300 m/min or more along the surface of a back edge portion and the surface of a doctor edge portion so that the liquid is applied to the surface of the carrier. In accordance with the invention, the surface of the doctor edge portion is curved, the inner longitudinal edge B of the surface of the back edge portion is located at the outlet of the slot so that the angle $\theta_1$ between a tangent to the surface of the back edge portion at the inner longitudinal edge B and a tangent to the surface of the doctor edge portion at the outer longitudinal edge A of the surface of the doctor edge portion and the angle $\theta_2$ between the former tangent and a tangent to the surface of the doctor edge portion and to the inner longitudinal edge B are as follows:

$$\theta_1 < \theta_2 < 180°,$$

and the radius of curvature R of the surface of the doctor edge portion is as follows:

$$R < 2.0 \text{ mm}.$$

DESCRIPTION OF THE PREFERRED EMBODIMENTS

Preferred embodiments of the present invention will hereafter be described in detail with reference to the attached drawings.

Figure 1:
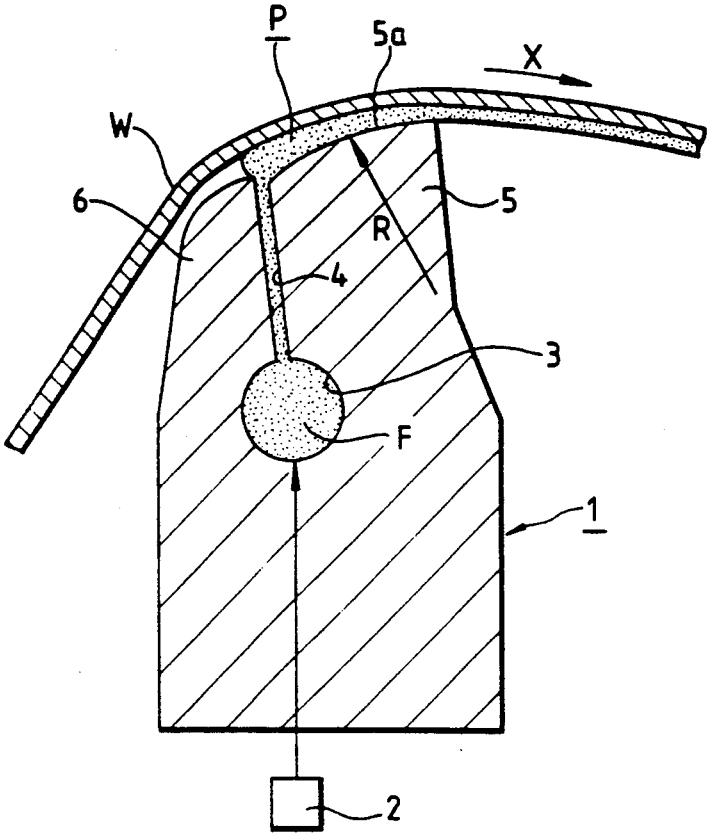
FIG. 1 is a sectional view of an application device of a preferred embodiment of the present invention in a state of applying a coating liquid to a carrier.
Figure 2:
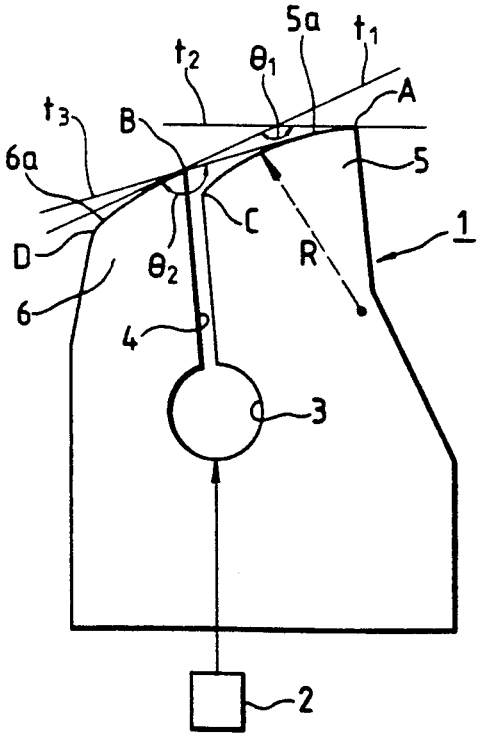
FIG. 2 is a sectional side of the application device of FIG. 1 view showing the geometry of the surfaces of the edge portions of the device.

FIG. 1 is a sectional view of an application device 1 constructed in accordance with a first preferred embodiment of the invention. The device 1 is of the extrusion type, and has doctor edge portion 5. The device 1 is disposed to perform application of a coating liquid to a carrier W, as shown in FIG. 1. FIG. 2 shows the geometry of the device 1, which is hereinafter often referred to as an extruder. The major part of the extruder 1 includes a liquid feed system 2, a pocket 3, a slot 4, the doctor edge portion 5, and a back edge portion 6.

The liquid feed system 2 includes a feed pump provided outside the body of the extruder 1 and which continuously supplies a liquid F at a prescribed f low rate to apply the liquid to the surface of the carrier W, and a pipe for connecting the pump to the pocket 3.

Figure 3:
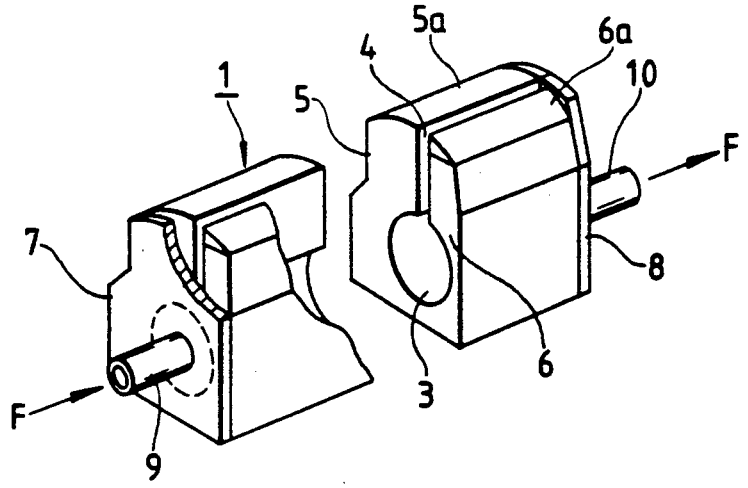
FIG. 3 is a perspective cutaway view of the device.

The pocket 3 is a liquid reservoir extending through the body of the extruder 1 along the width of the carrier W and having a nearly circular cross section almost throughout the total width of the carrier, as shown in FIG. 3. The effective length of the pocket 3 is equal to or slightly larger than the width of the liquid-applied portion of the carrier W. Both open ends of the pocket 3 are closed by seal plates 7 and 8 attached to both ends of the body of the extruder 1, as shown in FIG. 3.

The liquid feed system 2 is connected to a short pipe 9 projecting through the seal plate 7 to introduce the liquid F into the pocket 3 to fill it with the liquid. Another short pipe 10 projects through the other seal plate 8 so that a portion of the liquid F in the pocket 3 is drained therefrom through the short pipe 10 to prevent the liquid from staying long in the pocket 3. The prevention is particularly effective for a magnetic liquid which has a thixotropic property and is likely to cohere. However, depending upon the application at hand, the short pipe 10 need not always be provided.

The slot 4 is a relatively narrow passage having a width of 0.03 mm to 2 mm and extending through the body of the extruder 1 along the width of the carrier W as well as the pocket 3. The length of the slot 4 along the width of the carrier W is nearly equal to the width of the liquid-applied portion of the carrier. The height of the slot 4 toward the carrier W is appropriately set in consideration of conditions such as the composition, physical properties, flow rate and pressure of the liquid F so that the liquid flows in a laminar manner from the pocket i with a uniform flow rate and uniform pressure throughout the width of the carrier.

The doctor edge portion 5 is provided at the leading side of the outlet of the slot 4 with regard to the direction of movement of the carrier W. The back edge portion 6 is provided at the trailing side of the outlet of the slot 4 with regard to the direction of the movement of the carrier W. The surface of the doctor edge portion 5 is curved in accordance with the teachings of the present invention. As shown in FIG. 2, the inner longitudinal edge B of the surface 6*a* of the back edge portion 6 is located at the outlet of the slot 4 so that the angle $\theta_1$ between the tangent $t_1$ to the surface of the back edge portion 6 at the inner longitudinal edge B and the tangent $t_2$ to the surface 5*a* of the doctor edge portion 5 at the outer longitudinal edge A of the surface 5*a* and the angle $\theta_2$ between the tangent $t_1$ and the tangent $t_3$ to the surface of the doctor edge portion 5 and to the inner longitudinal edge B are as follows:

$$\theta_1<\theta_2<180^\circ$$

The radius of curvature R of the surface 5*a* of the doctor edge portion 5 is less than 2 mm. The effective width of the surface 5*a* of the doctor edge portion 5, which extends from the inner longitudinal edge C of the surface 5*a* to the outer longitudinal edge A thereof, is about 0.1 mm to about 2.0 mm. The effective width of the surface 6*a* of the back edge portion 6, which extends from the inner longitudinal edge B of the surface 6*a* to the outer longitudinal edge D thereof, is about 0.1 mm to about 50 mm. The surface 6*a* of the back edge portion 6 may be either flat or slightly curved.

Referring to FIG. 1, the carrier W is supported by an extruder support mechanism (not shown in the drawings), so that the carrier is moved near the body of the extruder 1, under a nearly constant tension, between guide rollers or the like, while remaining curved along the doctor edge portion 5 and the back edge portion 6. The carrier W can be slightly curved in the direction of thickness thereof.

When the liquid F has begun to be supplied at a desired flow rate from the liquid feed system 2, the liquid flows through the pocket 3 and the slot 4. The liquid F is then retained by the doctor edge portion 5*a* and the back edge portion 6*a* and thrust upward so that the liquid is expelled from the outlet of the slot 4 with a uniform distribution of flow rate and a uniform distribution of pressure throughout the width of the carrier W. Since the radius of curvature R of the surface 5*a* of the doctor edge portion 5 is less than 2 mm, the pressure of the liquid expelled from the outlet of the slot 4 is high. Also, the carrier W is moved at a very high speed, unlike the conventional application devices.

For these reasons, the behavior of the carrier W is kept stable. Even if the carrier W is moved at a speed of 300 m/min or more, air accompanying the carrier is prevented from being trapped in the liquid F thereon. The liquid F passes while being on the surface of the carrier W continuously moving in a direction X with a small gap relative to the doctor edge portion 5, as shown in FIG. 1, so that the liquid acts to increase the distance between the surface of the carrier W and the surface 5*a* of the doctor edge portion. For this reason, the liquid F can be very well applied to the surface of the carrier W even under the condition of $R<2$ mm, under which the liquid cannot be well applied to the carrier conventionally.

Since the radius of curvature R of the surface 5*a* of the doctor edge portion 5 is set to be as small as less than 2 mm, the pressure of the liquid F being applied to the carrier W can be locally increased without increasing the tension of the carrier. Therefore, the tension of the carrier W does not need to be increased to the point where the carrier W will be stretched.

When the above-described movement of the liquid F is continuously maintained, the entire surface 5*a* of the doctor edge portion 5 and the surface of the carrier W are separated from each other through stationary small gap by the liquid passing in the form of a thin layer between the doctor edge portion 5 and the carrier W throughout the entire width of the carrie W. Since the surface 5*a* of the doctor edge portion 5 does not project toward the carrier W any more than is actually necessary and is curved, foreign matter such as dust will not be caught on the surface. Since the liquid F is applied to the carrier W in a desired manner without increasing the tension of the carrier W, the carrier W is prevented from being stretched. The distance between the doctor edge portion 5 and the carrier W, which are separated from each other by the liquid F as mentioned above, depends on conditions such as the tension of the carrier W and the supplied quantity of the liquid. The above-mentioned distance, which is equal to the thickness of the layer of the applied liquid F on the carrier W, can be easily and accurately equalized to a desired value by setting only the supplied quantity of the liquid.

If the doctor edge portion 5 and the back portion 6 are made of a very hard alloy or a ceramic, the rectangularity and flatness of the portions can be made higher.

Figure 4:
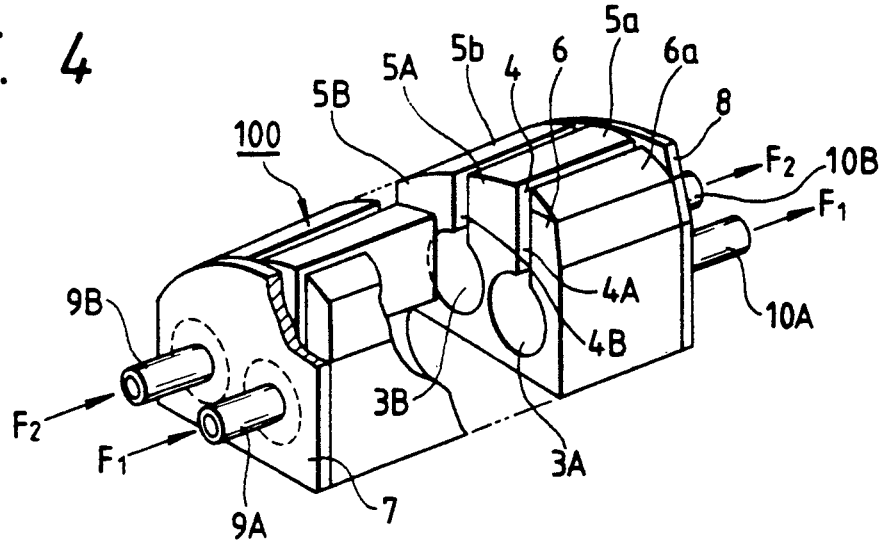
FIG. 4 is a perspective cutaway view of an application device which is a modification of the former and is for applying liquids for two layers at the same time.
Figure 5:
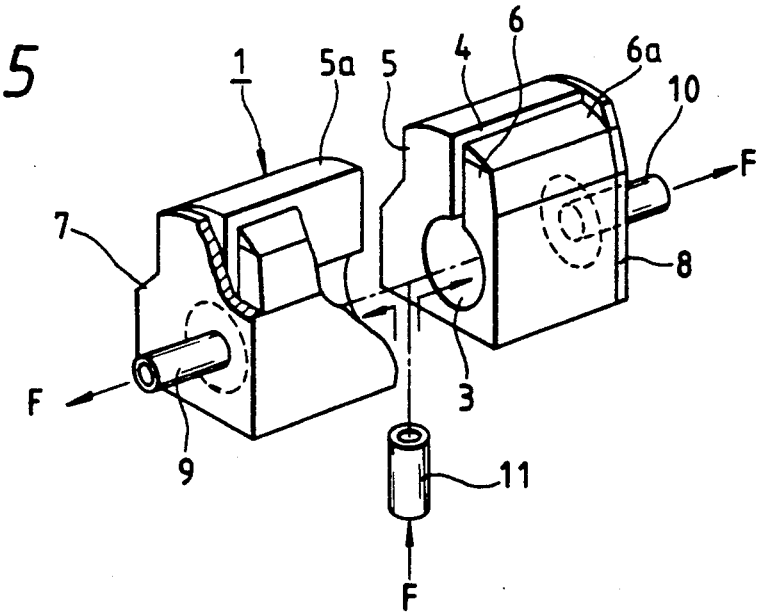
FIG. 5 is a perspective cutaway view of an application device which is another modification of the device shown in FIG. 1 and differs therefrom in the manner of supply of a liquid.

FIG. 4 and 5 show extruders which are modifications of the extruder 1 shown in FIG. 1, 2 and 3.

Figure 6:
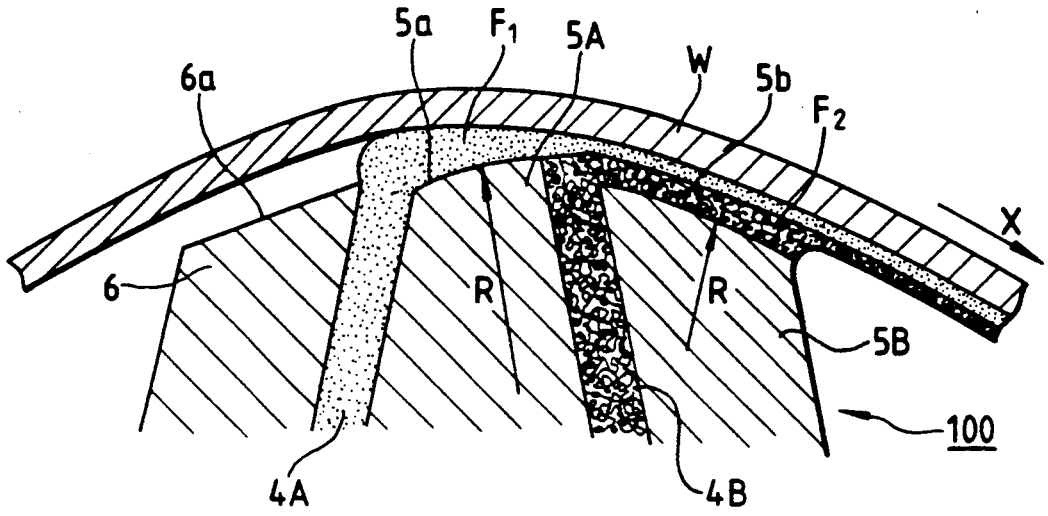
FIG. 6 is a partial sectional view of the device shown in FIG. 4 showing it applying coating liquids to a carrier.

The extruder 100 shown in FIGS. 4 and 6 can be used to apply two kinds of liquids $F_1$ and $F_2$ to a carrier to form layers of the respective two liquids thereon simultaneously. The extruder 100 has pockets 3A and 3B in which the liquids $F_1$ and $F_2$ are temporarily stored. The seal plates 7 and 8 of the extruder 100 are fitted with short pipes 9A and 9B for the supply of the liquids to the pockets 3A and 3B and short pipes 10A and 10B for draining of portions of the liquids from the pockets 3A and 3B. The extruder 100 also has slots 4A and 4B, a first doctor edge portion surface 5*a*, and a second doctor edge portion surface 5*b* located downstream to the first doctor edge portion surface 5*a*. The radius of curvature of the first doctor edge portion surface 5*a* is less than 2 mm, as is that of the doctor edge portion surface 5*a* of the extruder 1. The second doctor edge portion surface 5*b* may be a curved surface, a flat surface or a combination of flat surfaces. The constitution of the first doctor edge portion 5A is much more important than the constitution of the second doctor edge portion 5B of the extruder 100 in determining whether or not air accompanying the moving carrier W is trapped in the layers of the liquids $F_1$ and $F_2$ being simultaneously applied to the carrier so that the inner layer is formed by the liquid $F_1$ on the carrier along the first doctor edge portion 5*a* and the outer layer is formed by the other liquid $F_2$ on the inner layer along the second doctor edge portion 5*b*. Since the liquid $F_2$ forming the outer layer is sealed by the other liquid $F_1$ at the outlet of the slot 4B, the liquid $F_2$ is hardly affected by the air accompanying the carrier W. For that reason, the layer of the liquid $F_2$ can be made uniform and thin more easily than that of the liquid $F_1$. Because of the above-described constitution and operation of the extruder 100, the liquids $F_1$ and $F_2$ can be applied to the carrier W moving as rapidly as 300 m/min or more so as to form very thin layers thereon.

The extruder 1 shown in FIG. 5 has a short pipe 11 in addition to short pipes 9 and 10. The short pipe 11 communicates with the pocket 3 of the extruder 1 at nearly the center of the length thereof. The liquid F is supplied into the pocket 3 through the short pipe 11. A portion of the liquid F supplied into the pocket 3 is drained therefrom through the short pipes 9 and 10 provided at the two ends of the body of the extruder 1. The other portion of the liquid is expelled from the slot 4 of the body of the extruder 1 without dwelling for a long time therein, so that the distribution of the pressure of the portion of the liquid is made uniform.

The manner of supplying the liquids to be applied by the extruders 1 and 100 shown in FIG. 1, 2, 3, 4 and 5 is not confined to the above-described techniques, but may be performed in an appropriate combination of such techniques. The pockets 3 of the extruders 1 and 100 are not confined to being cylindrically shaped, but may be shaped as a prism, a ship bottom and so forth, as far as the distribution of the pressure of the liquid in each of the pockets is uniform throughout the width of the carrier W.

An application device provided in accordance with the present invention produces effects as follows:

(1) Since the surface of the doctor edge portion of the application device is curved convexly toward the carrier so that the radius of curvature of the surface is less than 2 mm, the pressure of the liquid being applied to the surface of the carrier is made high so that air accompanying the carrier is prevented from being caught up and trapped in the layer of the applied liquid on the carrier, even if the speed of the movement of the carrier is as high as 300 m/min or more. Moreover, foreign matter contained in the liquid or brought in by the moving carrier will not be caught on the surface of the doctor edge portion, so that streaking is prevented in the layer of the applied liquid on the carrier. Therefore, application of the coating liquid can be carried out rapidly and with good results for long periods of time. Since the pressure of the liquid being applied to the carrier is made high without increasing the tension of the carrier, the carrier is prevented from being stretched.

(2) Since the pressure of the liquid toward the carrier is kept appropriate because of the small curved surface of the doctor edge portion, a layer whose thickness is uniform and as small as about 10 μm can be formed with the applied liquid on the carrier.

(3) Since the pressure of the liquid at the outlet edge of the slot of the body of the device can be easily and precisely controlled to make it unlikely for foreign matter to adhere to the surface of the doctor edge portion, the carrier can be prevented from coming into contact with the doctor edge portion, thus preventing the carrier from scratching or being scratched by the doctor edge portion.

(4) Since the pressure of the liquid being applied to the carrier can be precisely controlled without a strong dependence on the tension of the carrier, liquids having various viscosities can be properly applied to the carrier without increasing the tension of the carrier so as to stretch the carrier and to thus reduce the quality of the product made from the carrier and the applied liquid. Therefore the range of the use of the device is wide.

The effects of the present invention will hereinafter be clarified through the description of Actual Examples 1 and 2 of embodiments of the present invention in comparison with examples of conventional devices.

ACTUATION EXAMPLES 1:

After substances in quantities as shown in Table 1 were put in a ball mill and well mixed and dispersed together, 30 parts by weight of an epoxy resin whose epoxy equivalent was 500 were added to the substances and uniformly mixed and dispersed therewith so that a magnetic liquid was obtained.

TABLE 1

| | |
|---|---|
| $\gamma$-$Fe_2O_3$ powder (spicular grains of 0.5 μm in average major diameter and 320 oersteds in coercive force) | 300 parts by weight |
| Copolymer of vinyl chloride and vinyl acetate (87:13 in copolymerization ratio and 400 in polymerization degree) | 30 parts by weight |
| Electroconductive carbon | 20 parts by weight |
| Polyamide resin (300 in amine value) | 15 parts by weight |
| Lecithin | 6 parts by weight |
| Silicone oil (dimethyl polysiloxane) | 3 parts by weight |
| Xylol | 300 parts by weight |
| Methylisobutyl ketone | 300 parts by weight |
| n-butanol | 100 parts by weight |

When the equilibrium viscosity of the magnetic liquid was measured using the Shimadzu rheometer RM-1 manufactured by Shimadzu Corp., the reading of the meter was 8 poise at a shearing speed of 10 $sec^{-1}$ and 1 poise at a shearing speed of 500 $sec^{-1}$. The magnetic liquid was applied to a carrier using each of the extruders mentioned hereinafter, under conditions also mentioned hereinafter, to form a single layer on the carrier.

(1) Carrier

| | |
|---|---|
| Material | polyethylene terephthalate |
| Thickness | 20 μm |
| Width | 300 mm |
| Tension | 4 kg per entire width |
| Speed of movement | 100 m/min, 200 m/min, 300 m/min, 400 m/min, 500 m/min, 600 m/min |

Figure 9:
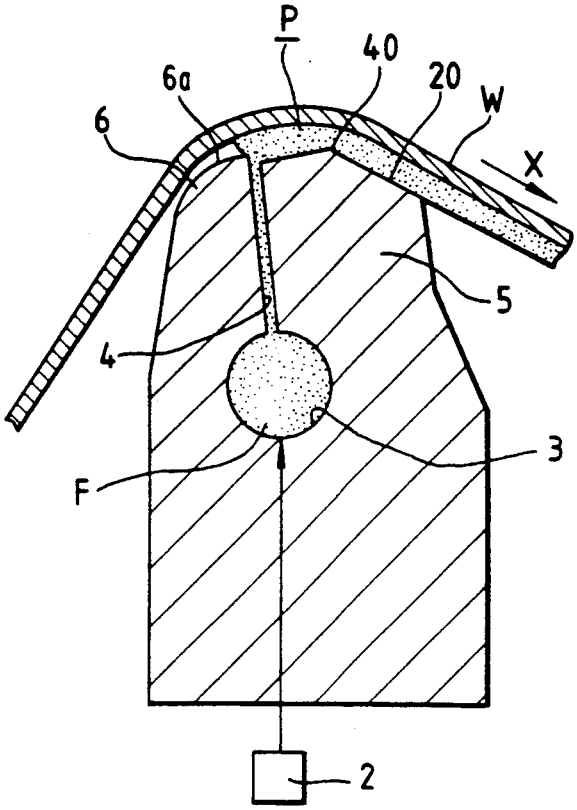
FIG. 9 PRIOR ART
FIG. 9 and 10 are sectional views of conventional application devices.
Figure 10:
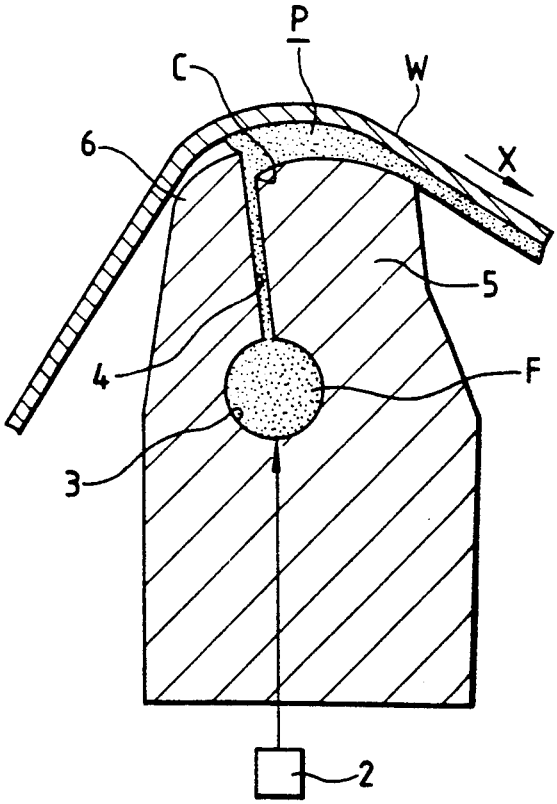
FIG. 10 PRIOR ART

(2) Extruder:

No. 1: extruder as shown in FIG. 1 measuring 1.0 mm in radius of curvature of surface of doctor edge portion No. 2: extruder as disclosed in Japanese Unexamined Published Patent Application No. 104666/83 (as shown in FIG. 9 herein) and whose doctor edge portion had a vertical angle of 165 degrees No. 3: extruder as disclosed in Japanese Unexamined Published Patent Application No. 238179/85 (as shown in FIG. 10 herein) and which measured 2.0 mm in radius of curvature of surface of doctor edge portion (3) Thickness of layer of applied liquid: 10 μm and 15 μm The results of application are shown in Table 2, wherein symbols ○ mean that the results were good, symbols Δ mean that the results were sometimes good but bad at other times, and symbols X mean that streaking occurred in the layer of the applied liquid on the carrier or air accompanying the carrier was trapped in the applied liquid, namely, the liquid was not uniformly applied to the carrier.

TABLE 2

| Speed of Movement | Thickness of Layer (μm) | | | | | | | | |
|---|---|---|---|---|---|---|---|---|---|
| | Extruder No. 1 | | | Extruder No. 2 | | | Extruder No. 3 | | |
| | 5 | 10 | 15 | 5 | 10 | 15 | 5 | 10 | 15 |
| 200 m/min | ○ | ○ | ○ | X | Δ | ○ | ○ | ○ | ○ |
| 300 m/min | ○ | ○ | ○ | X | X | Δ | X | Δ | ○ |
| 400 m/min | ○ | ○ | ○ | X | X | X | X | X | Δ |
| 500 m/min | ○ | ○ | ○ | X | X | X | X | X | X |
| 600 m/min | Δ | ○ | ○ | X | X | X | X | X | X |

Figure 7:
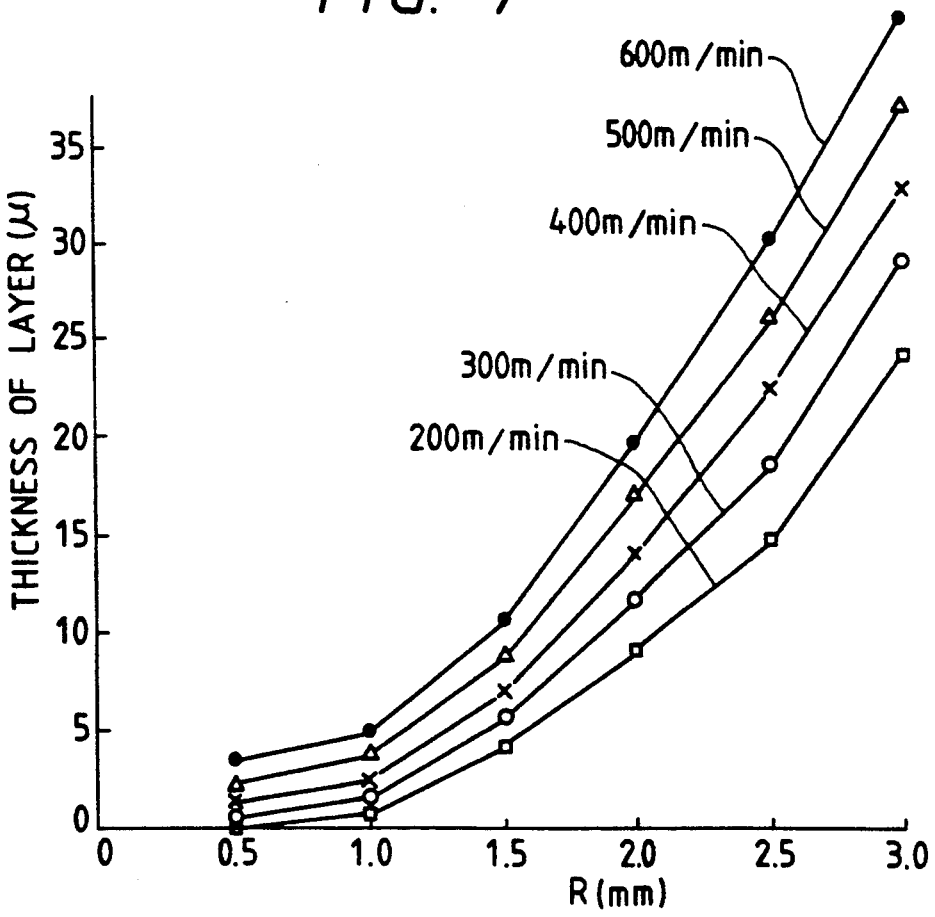
FIG. 7 is a graph indicating the relationship between the radius of curvature of the surface of a doctor edge portion and the applied quantity of liquid at the limit to entrapment of accompanying air.
Figure 8:
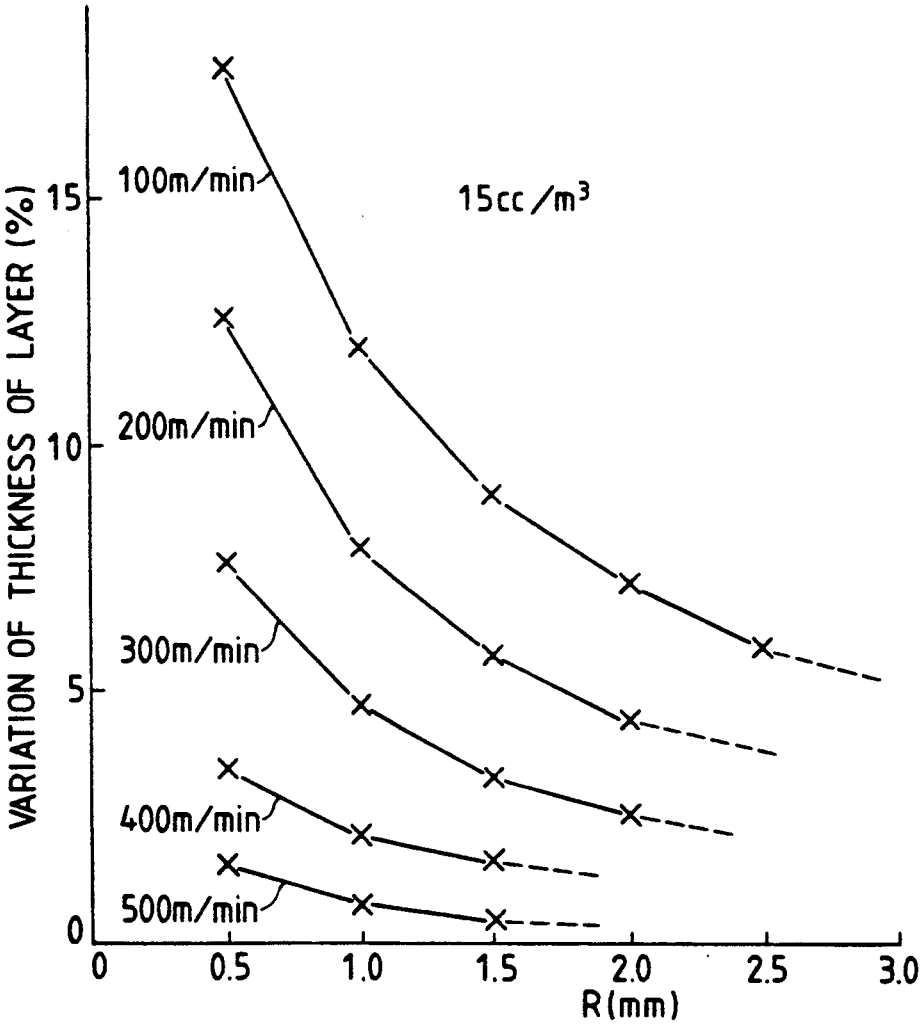
FIG. 8 is a graph indicating the relationship between the radius of curvature of the surface of the doctor edge portion and variations in the thickness of the layer of the applied liquid.

FIG. 7 shows the relationship between the radius of curvature of the surface of the doctor edge portion and the applied quantity of the liquid at the limit to the entrapment of the air accompanying the carrier. It is understood from FIG. 7 that the thickness of the layer which can be formed with the applied liquid on the carrier can be decreased according as the radius of curvature R is reduced. FIG. 8 shows the relationship between the radius of curvature R of the surface of the doctor edge portion and the variation in the thickness of the layer of the applied liquid on the carrier with the speed of the application as a parameter. The variation is calculated by dividing the maximum value of the change in the thickness along the total width of the layer by the mean value of the thickness along the total width, and then multiplying the quotient by 100 for percentage. It is understood from FIG. 8 that variations in the thickness are conspicuous at an application speed of 300 m/min or less, particularly when the radius of curvature of the surface of the doctor edge portion is 2.0 mm or less.

ACTUAL EXAMPLES 2:

After substances in quantities as shown in Table 3 were put in a ball mill and well mixed and dispersed together, 30 parts by weight of an epoxy resin whose epoxy equivalent was 500 were added to the substances and uniformly mixed and dispersed therewith so that a magnetic liquid was obtained. When the equilibrium viscosity of the magnetic liquid was measured by the Shimadzu rheometer RM-1 manufactured by Shimadzu Corp., the reading of the meter was 11 poise at a shearing speed of 10 $sec^{-1}$ and 2 poise at a shearing speed of 600 $sec^{-1}$. The magnetic liquid and the same magnetic liquid as in Actual Examples 1 were simultaneously applied to a carrier using each of the extruders mentioned hereinafter, under conditions also mentioned hereinafter, so that the latter liquid formed an inner layer on the carrier and the former liquid formed an outer layer on the inner layer.

TABLE 3

| | |
|---|---|
| $\gamma$-$Fe_2O_3$ powder (spicular grains of 0.5 μm in average major diameter and 320 oersteds in coercive force) | 300 parts by weight |
| Copolymer of vinyl chloride and vinyl acetate (87:13 in copolymerization ratio and 400 in polymerization degree) | 30 parts by weight |
| Electroconductive carbon | 20 parts by weight |
| Polyamide resin (300 in amine value) | 15 parts by weight |
| Lecithin | 6 parts by weight |
| Silicon oil (dimethyl polysiloxane) | 3 parts by weight |
| Xylol | 250 parts by weight |
| Methylisobutyl ketone | 250 parts by weight |
| n-butanol | 100 parts by weight |

(1) Carrier:

| | |
|---|---|
| Material | Polyethylene terephthalate |
| Thickness | 20 μm |
| Width | 300 mm |
| Tension | 4 kg per entire width |
| Speed of movement | 200 m/min, 300 m/min, 400 m/min, 500 m/min, 600 m/min, |

(2) Extruder:

No. 4: extruder as shown in FIG. 4 with first and second doctor edge portion surfaces having respective radii of curvature of 1.0 mm and 5.0 mm No. 5: extruder as disclosed in Japanese Published Unexamined Patent Application No. 104666/83 and measuring 165 degrees in the vertical angle of first doctor edge portion thereof and 170 degrees in the vertical angle of second doctor edge portion thereof No. 6: extruder as disclosed in the Japanese Patent Application No. 230173/86 and measuring 2.0 mm in the radius of curvature of first doctor edge portion thereof and 5.0 mm in the radius of curvature of second doctor edge portion (3) Thicknesses of layers of applied liquids:

| | |
|---|---|
| inner layer: | 15 μm |
| outer layer: | 2, 4 and 6 μm |

The results of the application are shown in Table 4 wherein symbols ○ mean that the results were good, symbols Δ mean that the results were sometimes good but bad at other times, and symbols X mean that streaking occurred in the layer of the applied liquid or air accompanying the carrier was trapped in the applied liquid, namely, the liquid was not uniformly applied to the carrier.

TABLE 4

| Speed of Movement | Thickness of Layer (μm) | | | | | | | | |
|---|---|---|---|---|---|---|---|---|---|
| | Extruder No. 1 | | | Extruder No. 2 | | | Extruder No. 3 | | |
| | 5 | 10 | 15 | 5 | 10 | 15 | 5 | 10 | 15 |
| 200 m/min | ○ | ○ | ○ | Δ | Δ | ○ | ○ | ○ | ○ |
| 300 m/min | ○ | ○ | ○ | X | X | Δ | Δ | ○ | ○ |
| 400 m/min | ○ | ○ | ○ | X | X | X | X | Δ | Δ |
| 500 m/min | ○ | ○ | ○ | X | X | X | X | X | X |
| 600 m/min | ○ | ○ | ○ | X | X | X | X | X | X |

Table 5 shows the relationship among the tension of the carrier, the lower limit to the applied quantity of the liquid, and the amount of stretching of the carrier for a radius of curvature of the surface of the doctor edge portion of 2 mm and a speed of application of 400 m/min. It is understood from Table 5 that along with the increase in the tension of the carrier, the lower limit to the applied quantity of the liquid decreased but the elongation of the carrier increased to thus reduce the quality of the product made of the carrier and the applied liquid.

TABLE 5

| Tension (kg · m/min) | 15 | 17.5 | 20 | 22.5 | 25 |
|---|---|---|---|---|---|
| Lower limit to applied quantity of liquid | 14.5 | 13.6 | 12.7 | 11.5 | 10.4 |
| Wrinkling or the like due to elongation of carrier | ○ | ○ | ○ | Δ | X |

It is understood from Tables 2 and 4 and FIG. 7 and 8 that Extruders No. 1 and No. 4 constructed in accordance with the present invention are more appropriate for rapidly applying the liquid in the form of a thin layer to the carrier than the conventional Extruders No. 2, No. 3, No. 5 and No. 6, namely, the former apply the liquid to the carrier more properly and uniformly than the latter, both in the case of forming a single layer on the carrier and in the case of forming two layers.

What is claimed is:

1. An extrusion-type application device for applying a liquid onto a surface of a flexible carrier, comprising: means for running a flexible carrier at a speed of at least 300 m/min; and an extruder having an extrusion slot defined between a back edge portion and a doctor edge portion, said liquid being expelled through said slot onto said surface of said carrier, a surface of said doctor edge portion being curved and having an effective width in a range of 0.1 to 2.0 mm, an inner longitudinal edge of a surface of said back edge portion being located at an outlet of said slot so that an angle $\theta_1$ between a tangent to said surface of said back edge portion at said inner longitudinal edge and a tangent to said surface of said doctor edge portion at an outer longitudinal edge of said surface of said doctor edge portion and an angle $\theta_2$ between said tangent to said surface of said back edge portion at said inner longitudinal edge and a tangent to said surface of said doctor edge portion and to said inner longitudinal edge are as follows:

$$\theta_1 < \theta_2 < 180^\circ,$$

and a radius of curvature R of said surface of said doctor edge portion is approximately 1.0 mm, whereby said liquid can be applied to said surface of the flexible carrier at a speed in excess of 300 m/min.

* * * * *